US011847958B2

(12) United States Patent
Kim

(10) Patent No.: US 11,847,958 B2
(45) Date of Patent: Dec. 19, 2023

(54) LIGHT EMITTING DISPLAY PANEL AND LIGHT EMITTING DISPLAY APPARATUS USING THE SAME

(71) Applicant: LG Display Co., Ltd., Seoul (KR)

(72) Inventor: HyunJin Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/562,328

(22) Filed: Dec. 27, 2021

(65) Prior Publication Data

US 2022/0208083 A1 Jun. 30, 2022

(30) Foreign Application Priority Data

Dec. 31, 2020 (KR) ..... 10-2020-0189725

(51) Int. Cl.
*G09G 3/32* (2016.01)

(52) U.S. Cl.
CPC ..... *G09G 3/32* (2013.01); *G09G 2300/0842* (2013.01); *G09G 2310/0275* (2013.01); *G09G 2320/0238* (2013.01); *G09G 2320/045* (2013.01)

(58) Field of Classification Search
CPC ..... G09G 3/32–3291; G09G 2300/0421–043; G09G 2300/0439; G09G 2300/0809; G09G 2300/0819; G09G 2300/0842; G09G 2300/0871; G09G 2310/0243; G09G 2310/0248; G09G 2310/0251; G09G 2310/0262; G09G 2310/0267–0275; G09G 2310/06–062; G09G 2310/067; G09G 2310/08; G09G 2320/0233–0242; G09G 2320/029; G09G 2320/0295; G09G 2320/043–046; G09G 2320/08
See application file for complete search history.

(56) References Cited

U.S. PATENT DOCUMENTS

| | | | | |
|---|---|---|---|---|
| 10,891,901 | B2 | 1/2021 | Lee et al. | |
| 2010/0079361 | A1* | 4/2010 | Lee | G09G 3/3233 345/77 |
| 2017/0092190 | A1* | 3/2017 | Choe | G09G 3/2003 |
| 2018/0151121 | A1* | 5/2018 | Lim | G09G 3/2081 |
| 2018/0308430 | A1* | 10/2018 | Xu | G09G 3/3233 |
| 2020/0005709 | A1* | 1/2020 | Kim | H01L 27/3248 |

FOREIGN PATENT DOCUMENTS

| | | | |
|---|---|---|---|
| KR | 10-2019-0138395 | A | 12/2019 |
| KR | 10-2020-0030348 | A | 3/2020 |

* cited by examiner

*Primary Examiner* — Nathan Danielsen
(74) *Attorney, Agent, or Firm* — Seed IP Law Group LLP

(57) ABSTRACT

A light emitting display panel and a light emitting display apparatus using the same are provided, in which a sensing line is provided in parallel with a gate line. The light emitting display panel comprises a data line provided along a first direction, a black line provided along the first direction, a first voltage supply line provided along the first direction, a gate line provided along a second direction different from the first direction, a sensing line provided along the second direction, a sensing control line provided along the second direction, a black control line provided along the second direction, a pixel driving circuit coupled with the data line, the black line, the first voltage supply line, the gate line, the sensing line, the sensing control line and the black control line, and a light emitting element coupled to the pixel driving circuit.

20 Claims, 11 Drawing Sheets

LIGHT EMITTING DISPLAY PANEL AND LIGHT EMITTING DISPLAY APPARATUS USING THE SAME

CROSS-REFERENCE TO RELATED APPLICATIONS

This application claims the benefit of the Korean Patent Application No. 10-2020-0189725 filed on Dec. 31, 2020, which are hereby incorporated by reference as if fully set forth herein.

BACKGROUND

Technical Field

The present disclosure relates to a light emitting display panel and a light emitting display apparatus using the same.

Description of the Related Art

A light emitting display apparatus includes a light emitting display panel provided with light emitting elements. The light emitting element self-emits light.

When the light emitting display apparatus is used for a long time, characteristics of a driving transistor provided in a pixel of the light emitting display panel are changed, whereby quality of an image output from the light emitting display panel may be deteriorated.

BRIEF SUMMARY

To prevent quality of the image of the light emitting display panel from being deteriorated, in the light emitting display apparatus of the related art, when the light emitting display apparatus is turned off, a threshold voltage of the driving transistor provided in the light emitting display panel is sensed, whereby a change amount of the threshold voltage (hereinafter, simply referred to as a threshold voltage change amount) is stored. When the light emitting display apparatus is turned on again, data voltages may be compensated using the stored threshold voltage change amounts. However, the inventors of the present disclosure have recognized that when the light emitting display apparatus is continuously used for a long time in a state that it is turned on, even though the threshold voltages of the driving transistors are changed, the data voltages cannot be compensated, whereby quality of the image may be deteriorated.

To prevent quality of the image from being deteriorated, the threshold voltages of the driving transistors may be sensed at one frame period while the light emitting display apparatus is being turned on and driven. In this case, in light emitting display apparatus based on a black image mode in which a black image is output after an image is output, a period at which an image or a black image is output may overlap a period at which a threshold voltage is sensed. Therefore, in the light emitting display apparatus of the related art based on the black image mode, the threshold voltage of the driving transistors cannot be sensed at one frame period while the light emitting display apparatus is being driven.

The inventors of the present disclosure have one or more problems in the related art including the above and provided one or more embodiments of a light emitting display panel and a light emitting display apparatus using the same, in which a sensing line is provided in parallel with a gate line.

Additional features of the present disclosure will be clearly understood by those skilled in the art from the following description of the present disclosure.

In accordance with an aspect of the present disclosure, the above and other technical benefits can be accomplished by the provision of a light emitting display panel comprising a data line provided along a first direction, a black line provided along the first direction, a first voltage supply line provided along the first direction, a gate line provided along a second direction different from the first direction, a sensing line provided along the second direction, a sensing control line provided along the second direction, a black control line provided along the second direction, a pixel driving circuit connected with the data line, the black line, the first voltage supply line, the gate line, the sensing line, the sensing control line and the black control line, and a light emitting element connected to the pixel driving circuit.

In accordance with another aspect of the present disclosure, the above and other benefits can be accomplished by the provision of a light emitting display apparatus comprising a light emitting display panel provided with light emitting elements, a data driver supplying a data voltage to a data line provided along a first direction of the light emitting display panel, a gate driver supplying a gate signal to a gate line provided in the light emitting display panel along a second direction different from the first direction, a sensing unit supplying a reference voltage to a sensing line provided in the light emitting display panel along the second direction or converting a sensing signal transmitted through the sensing line into sensing data, and a controller controlling the data driver, the gate driver and the sensing unit.

BRIEF DESCRIPTION OF THE SEVERAL VIEWS OF THE DRAWINGS

The above and other features and other advantages of the present disclosure will be more clearly understood from the following detailed description taken in conjunction with the accompanying drawings, in which.

DETAILED DESCRIPTION

Figure 1:
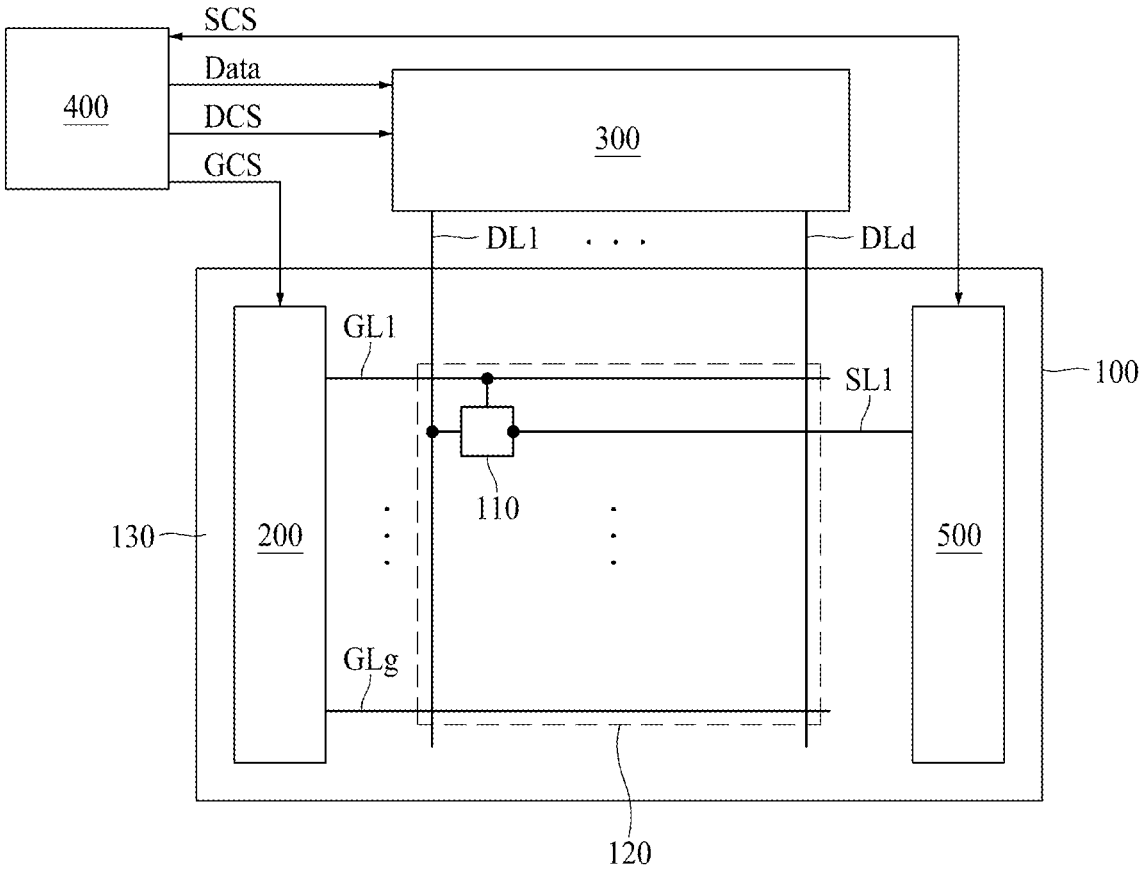
FIG. 1 is a view illustrating a configuration of a light emitting display apparatus according to the present disclosure.

Advantages and features of the present disclosure and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete and will fully convey the scope of the present disclosure to those skilled in the art.

In the drawings, the same or similar elements are denoted by the same reference numerals even though they are depicted in different drawings. Wherever possible, the same reference numbers will be used throughout the drawings to refer to the same or like parts.

A shape, a size, a ratio, an angle and a number disclosed in the drawings for describing embodiments of the present disclosure are merely an example and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise,' 'have' and 'include' described in the present disclosure are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~,' 'above~,' 'below~' and 'next to~,' one or more portions may be arranged between two other portions unless 'just' or 'direct' is used.

In describing a temporal relationship, for example, when the temporal order is described as "after," "subsequent," "next," and "before," a case which is not continuous may be included, unless "just" or "direct" is used.

The term "at least one" should be understood as including any and all combinations of one or more of the associated listed items. For example, the meaning of "at least one of a first item, a second item and a third item" denotes the combination of all items proposed from two or more of the first item, the second item and the third item as well as the first item, the second item or the third item.

It will be understood that, although the terms "first," "second," etc., may be used herein to describe various elements, these elements should not be limited by these terms. These terms are only used to partition one element from another. For example, a first element could be termed a second element, and, similarly, a second element could be termed a first element, without departing from the scope of the present disclosure.

The term "unit" as used throughout the specification includes within its meaning component, element, module, member, or the like.

The term "unit" may include any electrical circuitry, features, components, an assembly of electronic components or the like. That is, "unit" may include any processor-based or microprocessor-based system including systems using microcontrollers, integrated circuit, chip, microchip, reduced instruction set computers (RISC), application specific integrated circuits (ASICs), field-programmable gate arrays (FPGAs), graphical processing units (GPUs), logic circuits, and any other circuit or processor capable of executing the various operations and functions described herein. The above examples are examples only, and are thus not intended to limit in any way the definition or meaning of the term "unit."

In some embodiments, the various units described herein may be included in or otherwise implemented by processing circuitry such as a microprocessor, microcontroller, or the like.

Features of various embodiments of the present disclosure may be partially or overall coupled to or combined with each other and may be variously inter-operated with each other and driven technically as those skilled in the art can sufficiently understand. The embodiments of the present disclosure may be carried out independently from each other or may be carried out together in co-dependent relationship.

Hereinafter, the embodiments of the present disclosure will be described in detail with reference to the accompanying drawings.

Figure 2:
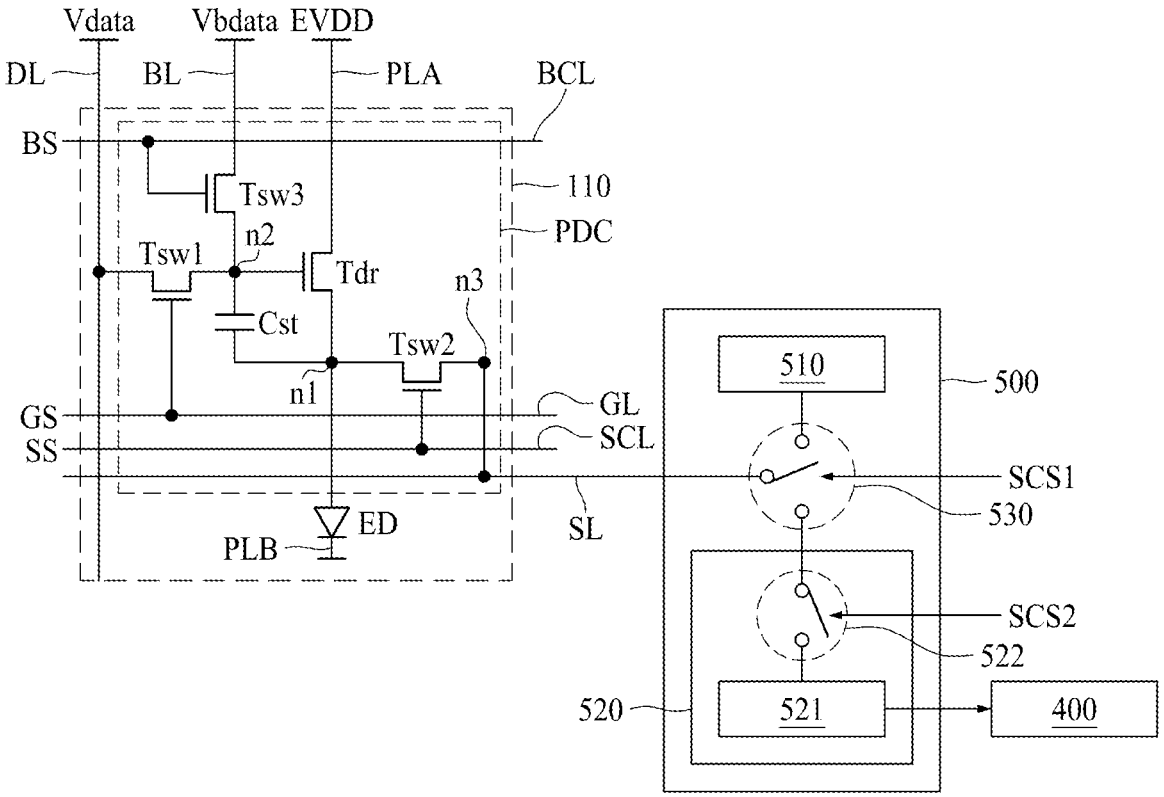
FIG. 2 is a view illustrating a structure of a pixel and a sensing unit, which are applied to a light emitting display apparatus according to the present disclosure.

FIG. 1 is a view illustrating a configuration of a light emitting display apparatus according to the present disclosure, and FIG. 2 is a view illustrating a structure of a pixel and a sensing unit, which are applied to a light emitting display apparatus according to the present disclosure.

The terms used in the following description will be defined as follows.

Light output from one pixel 110 will be referred to as an image, and a thing that is represented by images output from all pixels provided in the light emitting display panel 100 will be referred to as a picture. In particular, among the images, an image representing black will be referred to as a black image.

A period at which an image is output from a pixel will be referred to as an image output period, and a period at which a black image is output from a pixel will be referred to as a black image output period.

A period at which a threshold voltage of a driving transistor Tdr is sensed will be referred to as a threshold voltage sensing period. After the black image is output from the pixels 110 connected to one gate line, a threshold voltage is sensed from any one of the pixels 110 connected to one gate line. Therefore, based on one gate line, the threshold voltage sensing period may be included in the black image output period.

A frame may refer to one picture output through pixels provided in the light emitting display panel 100, and may refer to image data corresponding to one picture or data voltages corresponding to one picture. Therefore, first to (k)th pictures that are continuous to one another may be first to (k)th frames, wherein k is a natural number.

One frame period means a period corresponding to a frame. That is, one frame period refers to a total period until one picture is output through the light emitting display panel 100. In addition, one frame period means a total period from the time when images are output through a first gate line GL1 shown in FIG. 1 to the time when images are output through a (g)th gate line GLg to display one picture.

In this case, one frame period of a first frame will be referred to as a first frame period, one frame period of a second frame will be referred to as a second frame period, and one frame period of an (s)th frame will be referred to as an (s)th frame period.

A period between the first frame period and the second frame period will be referred to as a blank period.

In a light emitting display apparatus in which a black image mode is used, a black image is output after an image is output at one frame period. As a black image is output between continuous images, the images may clearly be expressed.

Hereinafter, a configuration of the light emitting display apparatus according to the present disclosure will be described.

The light emitting display apparatus according to the present disclosure may constitute various electronic devices. The electronic device may be, for example, a smart phone, a tablet PC, a television, a monitor, or the like.

As shown in FIG. 1, the light emitting display apparatus according to the present disclosure includes a light emitting display panel 100 provided with light emitting elements ED, including a display area 120, on which an image is output, and a non-display area 130 provided outside the display area, a data driver 200 for supplying a data voltage Vdata to a data line DL provided along a first direction of the light emitting display panel 100, a gate driver 200 for supplying a gate signal GS to a gate line GL provided in the light emitting display panel 100 along a second direction different from the first direction, a sensing unit 500 for supplying a reference voltage to a sensing line SL provided in the light emitting display panel 100 along the second direction or converting a sensing signal transmitted through the sensing line SL into sensing data, and a controller 400 for controlling the data driver 300, the gate driver 200 and the sensing unit 500.

First of all, the light emitting display panel 100 includes the display area 120 and the non-display area 130.

The display area 120 is provided with gate lines GL1 to GLg, data lines DL1 to DLd, sensing lines SL, sensing control lines SCL and pixels 110, wherein g and d are natural numbers.

That is, the light emitting display panel 100 includes a data line DL provided along the first direction, a black line BL provided along the first direction, a first voltage supply line PLA provided along the first direction, a gate line GL provided along the second direction, a sensing line SL provided along the second direction, a sensing control line SCL provided along the second direction, a black control line BCL provided along the second direction, a pixel driving circuit PDC connected with the data line DL, the black line BL, the first voltage supply line PLA, the gate line GL, the sensing line SL, the sensing control line SCL and the black control line BCL, and a light emitting element ED connected to the pixel driving circuit PDC.

The pixel driving circuit PDC includes a driving transistor Tdr connected between the first voltage supply line PLA and the light emitting element ED, a switching transistor Tsw1 connected between a gate of the driving transistor Tdr and the data line DL, a black transistor Tsw3 connected between the gate of the driving transistor Tdr and the black line BL, a sensing transistor Tsw2 connected between a first node n1 between the driving transistor Tdr and the light emitting element ED and the sensing line SL, and a storage capacitor Cst provided between the gate of the driving transistor Tdr and the first node n1.

That is, the pixel 110 provided in the light emitting display panel 100 may include a pixel driving circuit PDC and a light emitting unit, wherein the pixel driving circuit PDC may include a switching transistor Tsw1, a storage capacitor Cst, a driving transistor Tdr, a sensing transistor Tsw2, and a black transistor Tsw3, and the light emitting unit may include a light emitting element ED. In the light emitting display panel 100, pixel areas provided with pixels 110 are formed, and signal lines for supplying various signals to the pixel driving circuit PDC provided in the pixel 110 are provided. The signal lines may include the data line DL, the black line BL, the first voltage supply line PLA, the gate line GL, the sensing line SL, the sensing control line SCL and the black control line BCL, as described above.

The switching transistor Tsw1 constituting the pixel driving circuit PDC is turned on or off by a gate signal GS supplied to the gate line GL, and the data voltage Vdata supplied through the data line DL is supplied to the gate of the driving transistor Tdr when the switching transistor Tsw1 is turned on. A first voltage EVDD is supplied to the driving transistor Tdr and the light emitting element ED through the first voltage supply line PLA, and a second voltage EVSS is supplied to the light emitting element ED through a second voltage supply line PLB.

The sensing transistor Tsw2 is turned on or off by a sensing control signal SS supplied through the sensing control line SCL.

The sensing line SL is connected to the sensing transistor Tsw2. A reference voltage may be supplied from the sensing unit 500 to the pixel 110 through the sensing line SL.

As shown in FIGS. 1 and 2, the sensing line SL is provided in a direction parallel with the gate line GL. For example, in FIGS. 1 and 2, when a direction in which the data line DL is provided is the first direction, the first direction may be a vertical direction of the light emitting display panel 100. In this case, the gate line GL may be provided in a direction different from the first direction, that is, in the second direction, and the second direction may be a horizontal direction of the light emitting display panel 100. Therefore, the sensing line SL may be provided in a second direction parallel with the gate line GL, for example, in the horizontal direction of the light emitting display panel 100.

The first and second directions may be, but not limited to, perpendicular to each other.

Since the sensing line SL is provided in a direction parallel with the gate line GL, image output and threshold voltage sensing may be performed simultaneously. That is, when an image is output from pixels connected with at least one sensing line SL, threshold voltage sensing may be performed in a pixel connected to another sensing line SL. In this case, the threshold voltage sensing means sensing the threshold voltage of the driving transistor Tdr. The sensing signal related to the threshold voltage of the driving transistor Tdr may be transmitted to the sensing unit 500 through the sensing transistor Tsw2 and the sensing line SL. Therefore, a change amount of the threshold voltage (hereinafter, simply referred to as threshold voltage change amount) may be calculated.

The black transistor Tsw3 is turned on or off by the black control signal BS supplied through the black control line BCL. The black transistor Tsw3 is turned on at a timing when a black data voltage Vbdata is supplied to the pixel.

The data voltage Vdata supplied through the data line DL or the black data voltage Vbdata supplied through the black line BL is stored in the storage capacitor Cst.

The light emitting element ED may include any one of an organic light emitting layer, an inorganic light emitting layer and a quantum dot light emitting layer, or may include a deposited or mixed structure of an organic light emitting layer (or inorganic light emitting layer) and a quantum dot light emitting layer.

The light emitting element ED may emit light corresponding to any one of various colors such as red, green and blue colors, or may emit white light.

The data driver 300 may be provided in a chip-on film attached to the light emitting display panel 100, and may also be connected to a main substrate provided with the controller 400. In this case, lines for electrically connecting the controller 400, the data driver 300 and the light emitting display panel 100 are provided in the chip-on-film. Accordingly, in some embodiments, the lines are electrically connected with pads provided in the main substrate and the light emitting display panel 100. The main substrate is electrically connected with an external substrate on which an external system is mounted.

The data driver 300 may be directly mounted on the light emitting display panel 100 and then electrically connected with the main substrate.

However, the data driver 300 may be formed as one integrated circuit together with the controller 400, wherein the integrated circuit may be provided in the chip-on film or directly mounted on the light emitting display panel 100.

The data driver 300 may include a sensing unit 500, and in this case, the data driver 300 and the sensing unit 500 may be formed as one integrated circuit (IC).

The gate driver 200 may be provided as an integrated circuit and then mounted on the non-display area 130, or may directly be embedded in the non-display area 130 using a gate-in-panel (GIP) scheme. When the gate-in-panel scheme is used, the transistors constituting the gate driver 200 may be provided in the non-display area 130 through the same process as that of the transistors provided in the respective pixels 110 of the display area 120.

When the gate pulse generated by the gate driver 200 is supplied to a gate of the switching transistor Tsw1 provided in the pixel 110, the switching transistor Tsw1 is turned on, whereby light may be output from the pixel. When a gate-off signal is supplied to the gate of the switching transistor Tsw1, the switching transistor Tsw1 is turned off, whereby light is not output from the pixel. The gate signal GS supplied to the gate line GL includes a gate pulse and a gate-off signal.

When the black pulse generated by the gate driver 200 is supplied to a gate of the black transistor Tsw3 provided in the pixel 110 through the black control line BCL, the black transistor Tsw3 is turned on, whereby the black data voltage Vbdata may be supplied to the gate of the driving transistor Tdr through the black transistor Tsw3. When the black-off signal is supplied to the gate of the black transistor Tsw3, the black transistor Tsw3 is turned off. The black control signal BS supplied to the black control line BCL includes a black pulse and a black-off signal.

When a sensing pulse generated by the gate driver 200 is supplied to a gate of the sensing transistor Tsw2 provided in the pixel 110 through the sensing control line SCL, the sensing transistor Tsw2 is turned on, and when a sensing-off signal is supplied to the gate of the sensing transistor Tsw2, the sensing transistor Tsw2 is turned off. The sensing control signal SS supplied to the sensing control line SCL includes a sensing pulse and a sensing-off signal.

Next, the sensing unit 500 receives the sensing signal related to the threshold voltage of the driving transistor Tdr provided in the light emitting display panel 100 from the pixel 110 and transmits the sensing signal to the controller 400.

The sensing unit 500 includes a reference voltage generator 510 for generating a reference voltage, a conversion unit 520 for converting the sensing signal received through the sensing line SL into digital sensing data and transmitting the sensing data to the controller 400, and a switching unit 530 for connecting the sensing line SL to the reference voltage generator 510 or the conversion unit 520.

The conversion unit 520 includes a converter 521 for converting the sensing signal into digital sensing data and transmitting the sensing data to the controller 400, and a switch 522 for connecting the converter 521 to the switching unit 530 or not connecting the converter 521 to the switching unit 530.

A first switching control signal SCS1 for controlling the switching unit 530 and a second switching control signal SCS2 for controlling the switch 522 may be generated by the controller 400. That is, the controller 400 generates a sensing control signal SCS for controlling the sensing unit 500, and the sensing control signal SCS includes the first switching control signal SCS1 and the second switching control signal SCS2.

Since the sensing line SL is provided in parallel with the gate line GL, the sensing unit 500 may be provided in an area facing the gate driver 200 with the display area 120 interposed therebetween, as shown in FIG. 1.

However, the sensing unit 500 may be provided in the non-display area 130 provided with the gate driver 200, together with the gate driver 200.

When the gate driver 200 is provided in two areas of the non-display area 130, which face each other with the display area 120 interposed therebetween, the sensing unit 500 may be provided in at least one of the two areas provided with the gate driver 200, together with the gate driver 200.

When the gate driver 200 is provided as an integrated circuit IC, the gate driver 200 may include a sensing unit 500, and in this case, the gate driver 200 and the sensing unit 500 may be formed of one integrated circuit IC.

Finally, the controller 400 may include a data aligner for realigning input image data transmitted from the external system using a timing synchronization signal transmitted from the external system and supplying the realigned image data Data to the data driver 300, a control signal generator for generating a gate control signal GCS and a data control signal DCS by using the timing synchronization signal, an input unit for receiving the timing synchronization signal and the input image data transmitted from the external system and transmitting them to the data aligner and the control signal generator, and an output unit for outputting the image data Data generated from the data aligner and the control signals DCS and GCS generated from the control signal generator to the data driver 300 or the gate driver 200.

The input unit may determine a change amount of a threshold voltage of the driving transistor provided in the pixel, by using the sensing data received from the sensing unit 500, and calculates a correction value by using the change amount of the threshold voltage. When the input image data corresponding to the pixel in which the correction value is calculated is received, the input unit transmits the input image data and the correction value to the data aligner.

The data aligner generates image data Data by using the received input image data and the correction value. The generated image data Data is transmitted to the data driver 300 through the output unit.

The data driver 300 converts the image data Data into a data voltage Vdata and transmits the data voltage Vdata to the pixel through the data line DL. Therefore, an image based on the data voltage Vdata in which the correction value is reflected is output from the pixel.

Therefore, even though the threshold voltage of the driving transistor Tdr provided in the pixel is changed as the light emitting display apparatus is used for a long time, a normal image may be output from the corresponding pixel.

In addition, the data aligner may generate black image data. The data driver 300 converts the black image data into the black data voltage Vbdata and transmits the black data voltage to the pixel through the data line DL. Therefore, a black image is output from the pixel.

In addition to the gate control signal GCS and the data control signal DCS, the control signal generator may generate a sensing control signal SCS for controlling the sensing unit 500, as described above. The sensing control signal SCS may include a first switching control signal SCS1 for controlling the switching unit 530 shown in FIG. 2 and a second switching control signal SCS2 for controlling the switch 522, as described above.

The output unit transmits the image data Data and the black image data, which are generated by the data aligner, and the data control signal DCS generated by the control signal generator to the data driver 300, transmits the gate control signal GCS generated by the control signal generator to the gate driver 200, and transmits the sensing control signal SCS generated by the control signal generator to the sensing unit 500.

The external system serves to drive the controller 400 and the electronic device. That is, when the electronic device is a smart phone, the external system receives various kinds of voice information, image information and text information through a wireless communication network and transmits the received image information to the controller 400. The image information may be the input image data.

Hereinafter, a method of driving a light emitting display apparatus according to the present disclosure will be described with reference to FIGS. 1 to 10.

Figure 3:
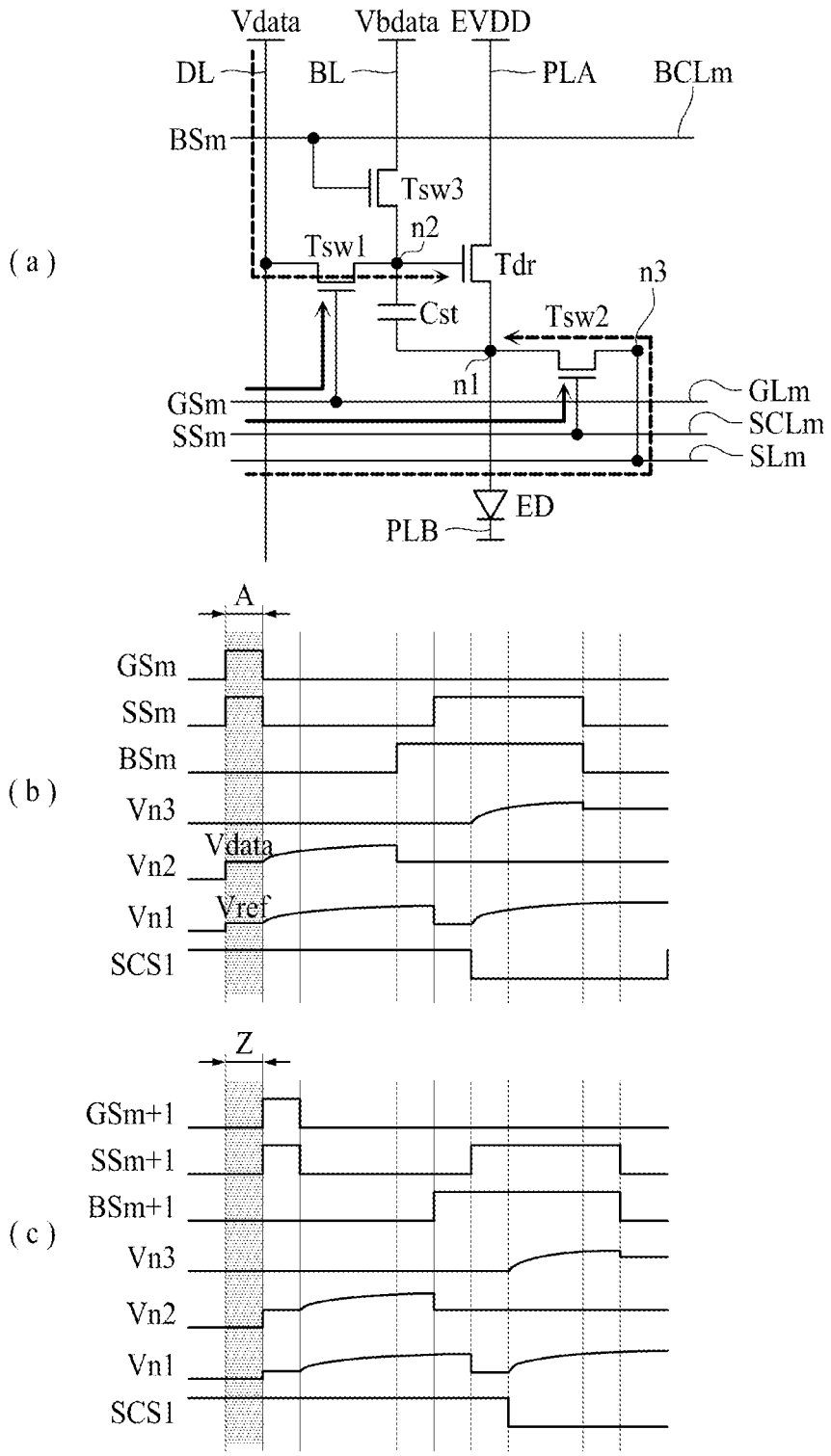
FIG. 3 is a view illustrating a data writing period of a light emitting display apparatus according to the present disclosure.
Figure 4:
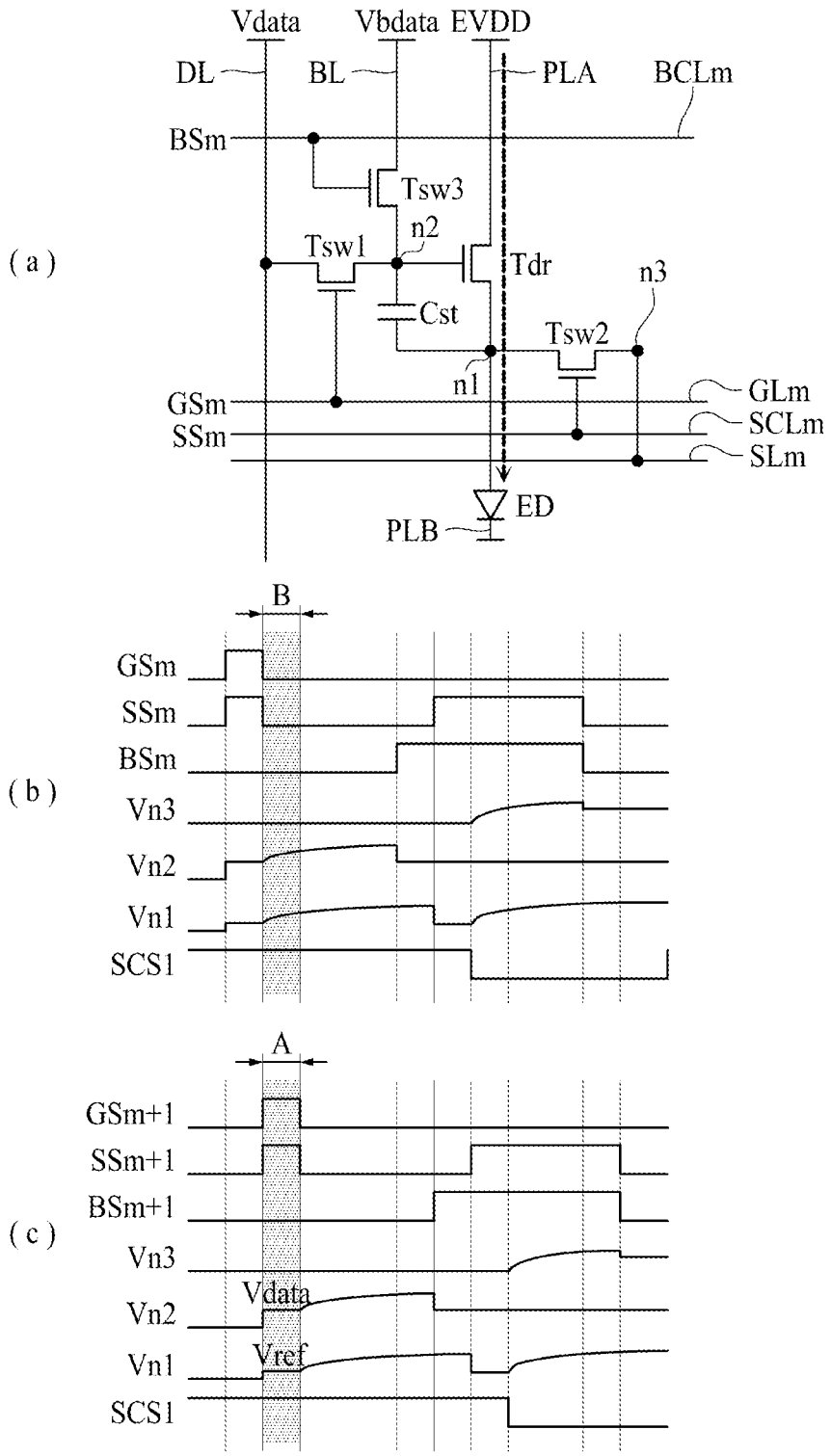
FIGS. 4 and 5 are views illustrating a light emitting period of a light emitting display apparatus according to the present disclosure.
Figure 5:
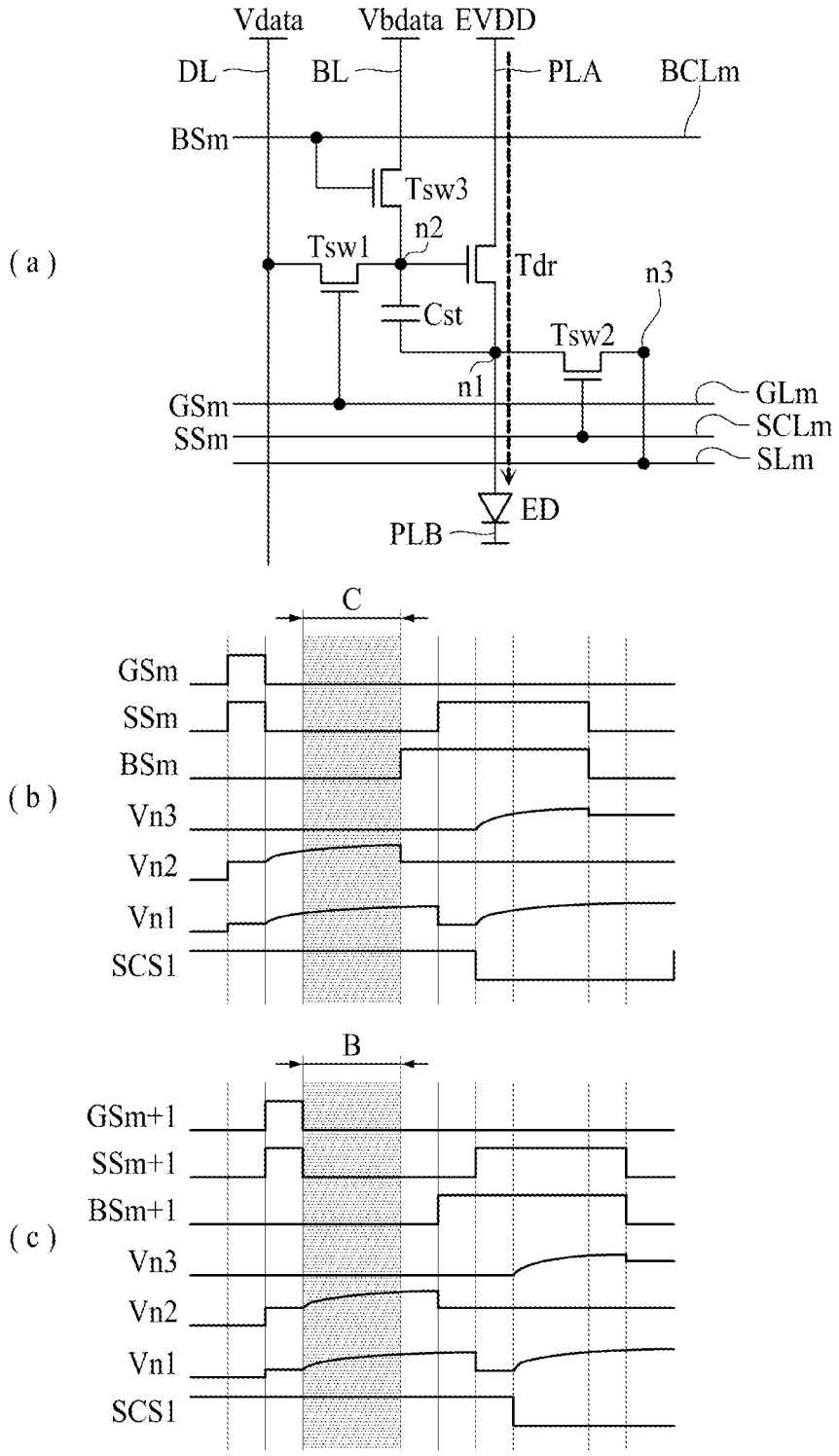
Figure 6:
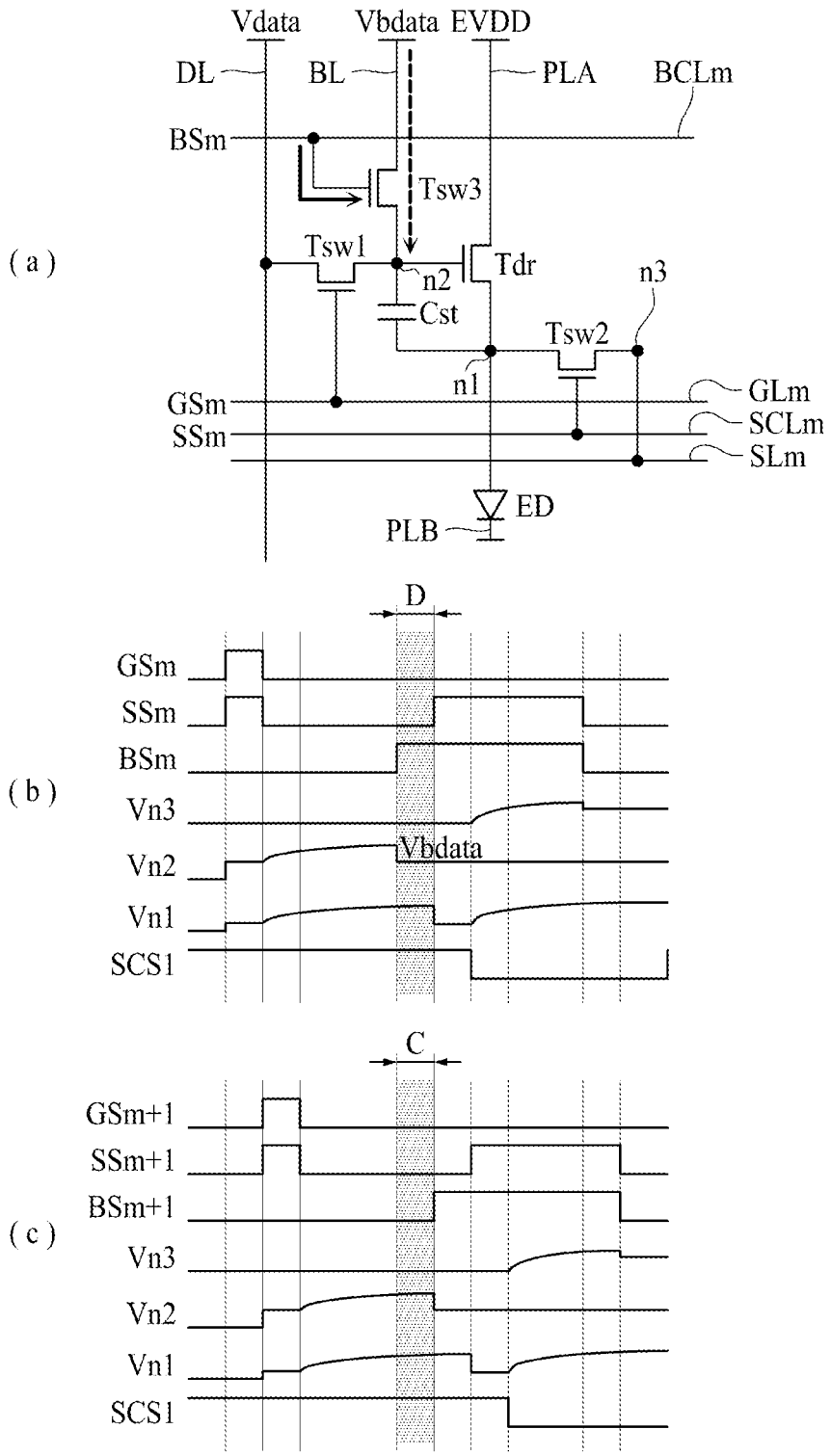
FIG. 6 is a view illustrating a black output period of a light emitting display apparatus according to the present disclosure.
Figure 7:
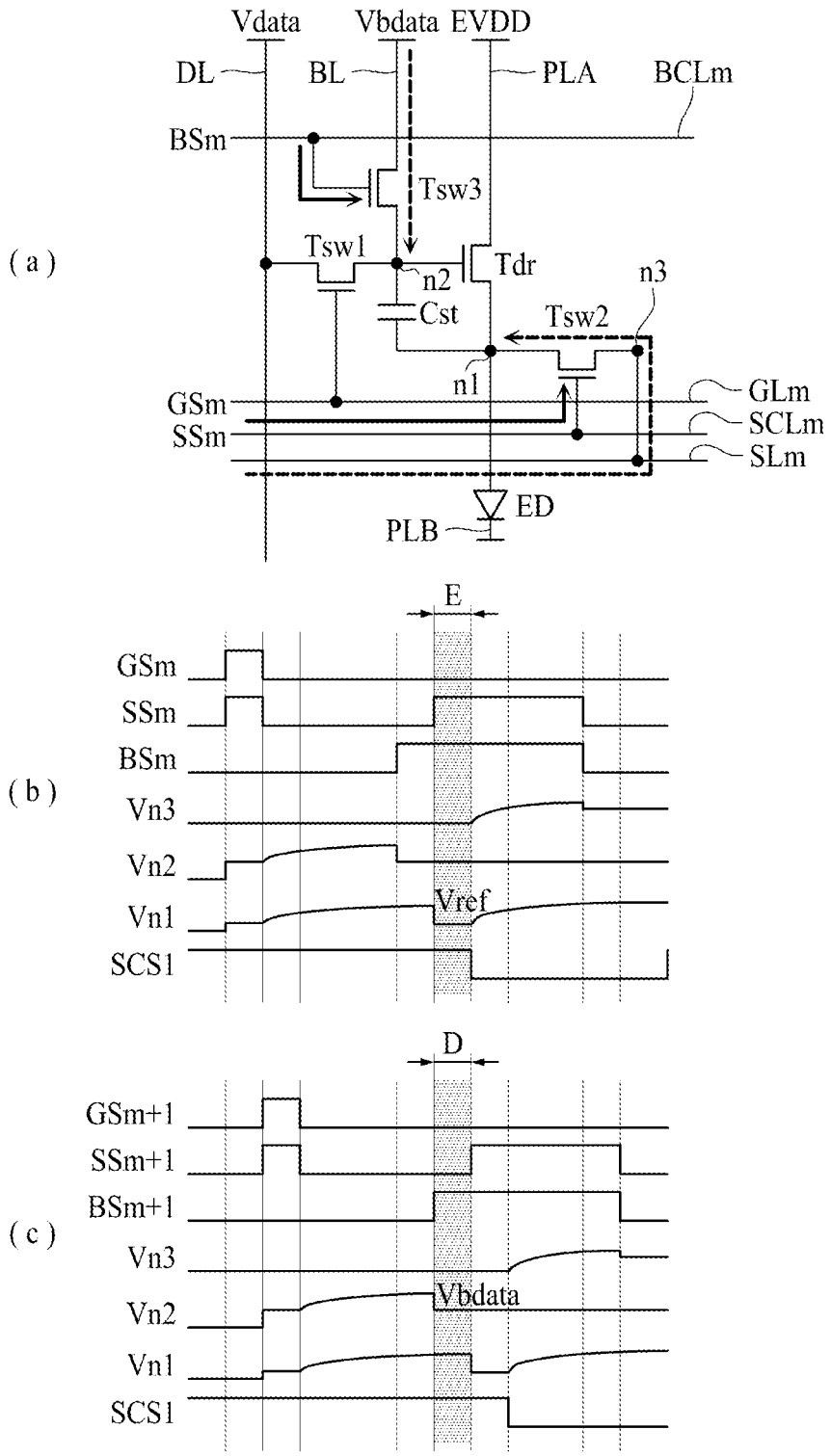
FIG. 7 is a view illustrating an initialization period of a light emitting display apparatus according to the present disclosure.
Figure 8:
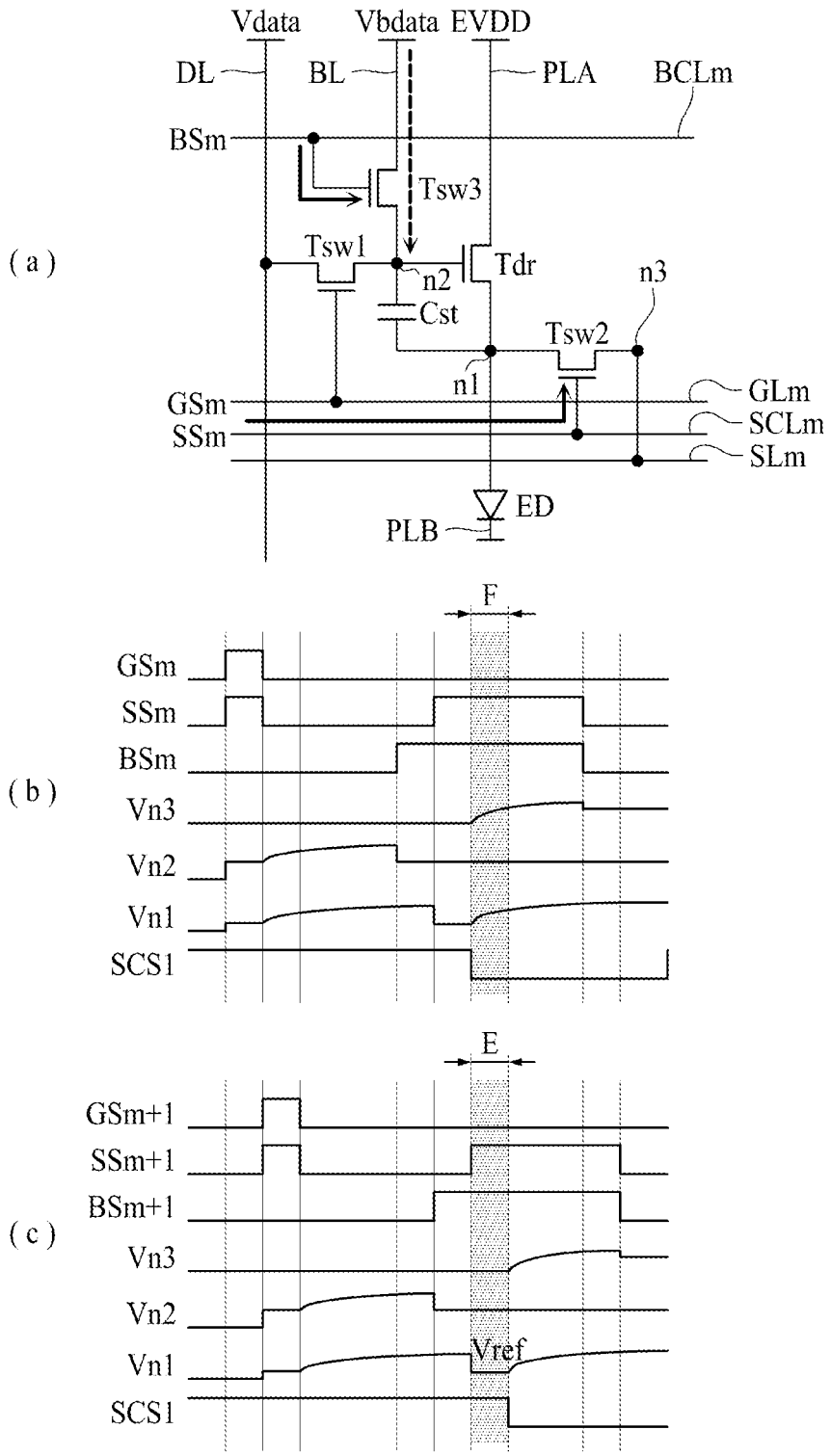
FIGS. 8 and 9 are views illustrating a sensing period of a light emitting display apparatus according to the present disclosure.
Figure 9:
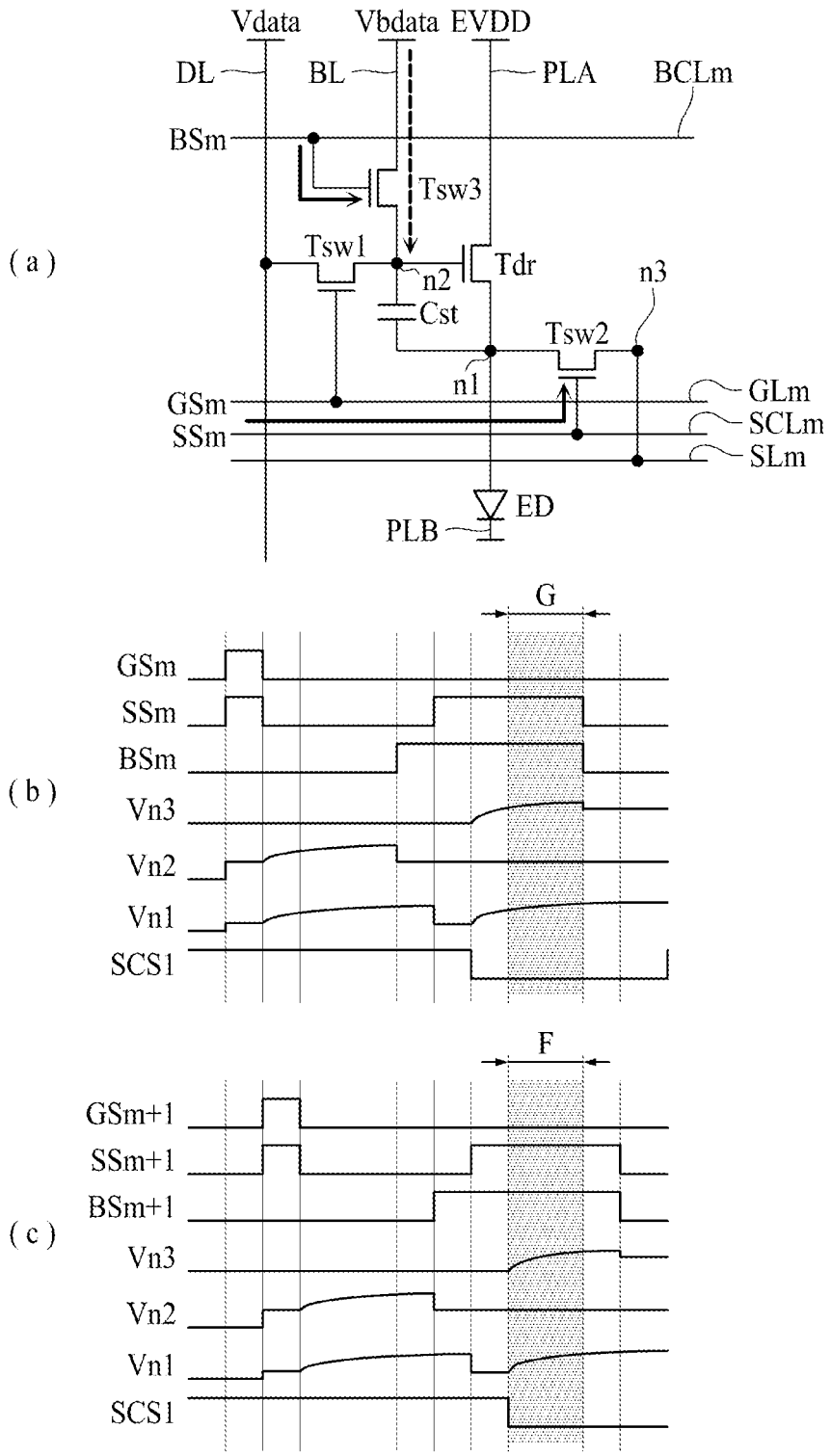
Figure 10:
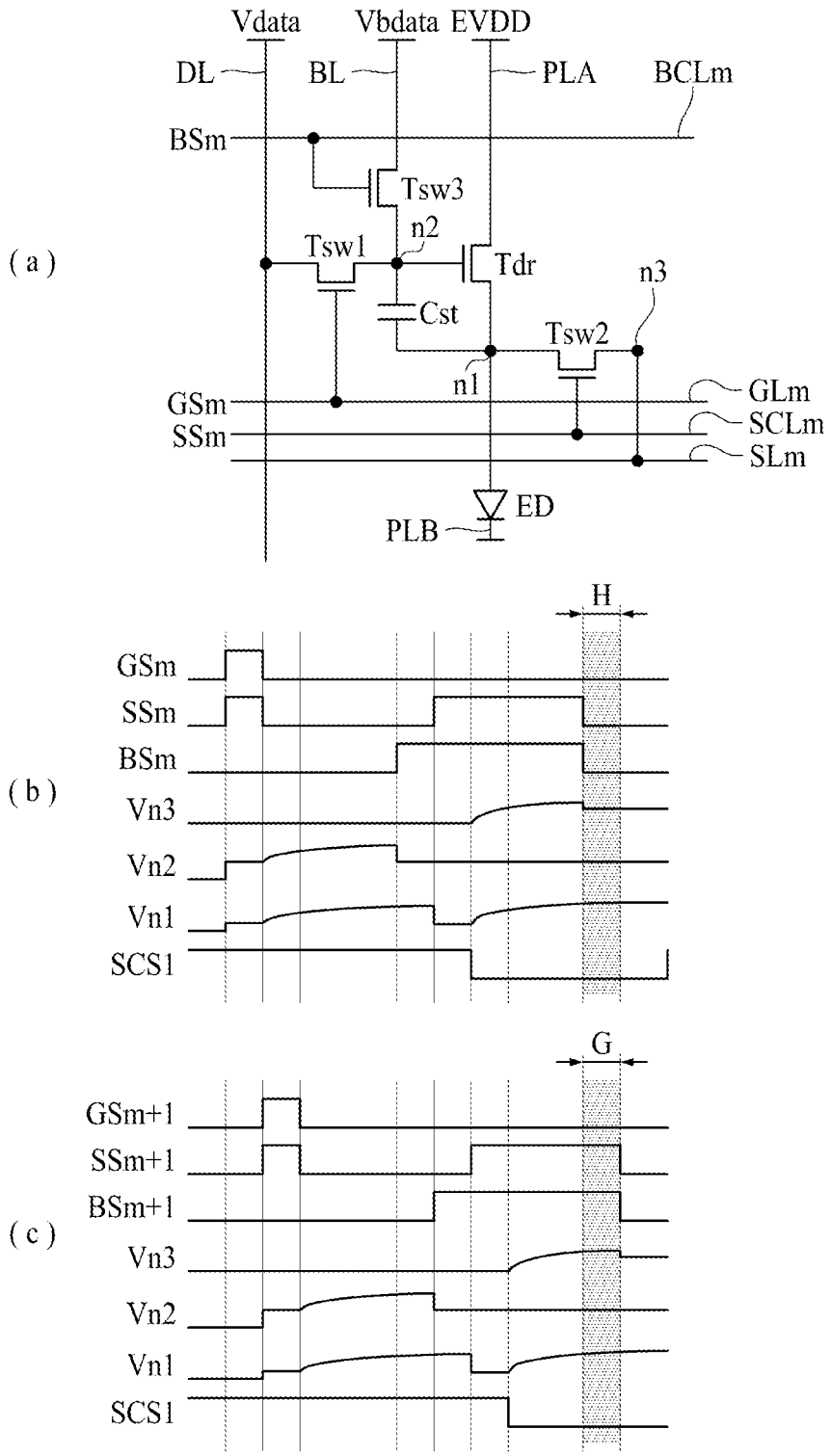
FIG. 10 is a view illustrating a sampling period of a light emitting display apparatus according to the present disclosure.
Figure 11:
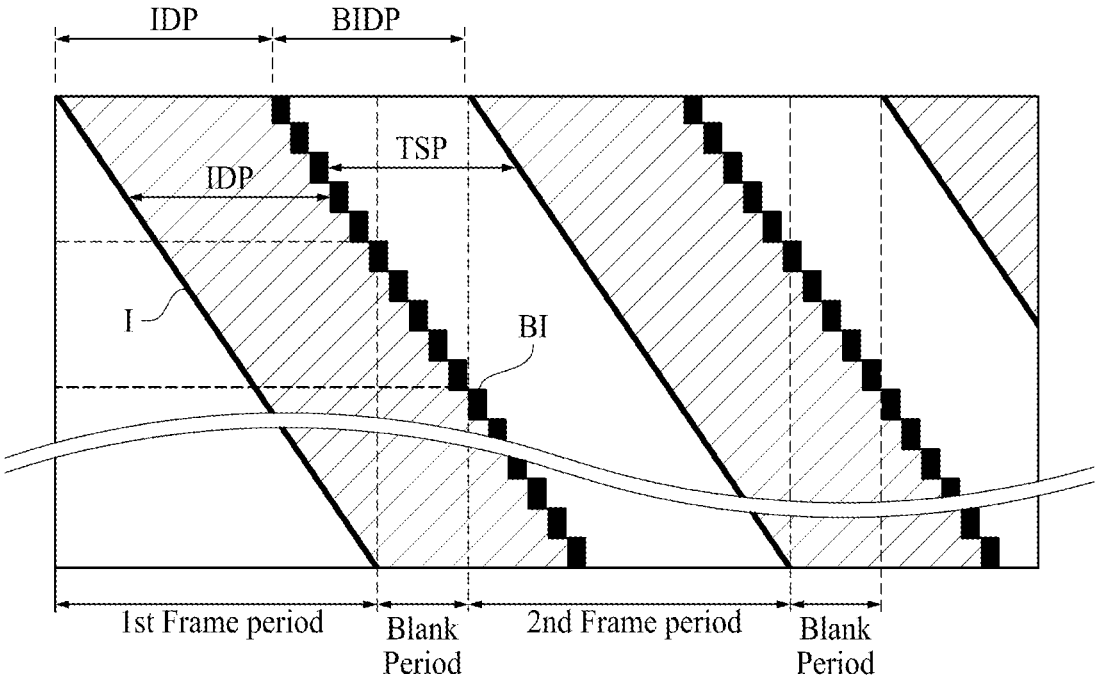
FIG. 11 is a timing view illustrating a whole operation method of a light emitting display apparatus according to the present disclosure.

FIG. 3 is a view illustrating a data writing period of a light emitting display apparatus according to the present disclosure, FIGS. 4 and 5 are views illustrating a light emitting period of a light emitting display apparatus according to the present disclosure, FIG. 6 is a view illustrating a black output period of a light emitting display apparatus according to the present disclosure, FIG. 7 is a view illustrating an initialization period of a light emitting display apparatus according to the present disclosure, FIGS. 8 and 9 are views illustrating a sensing period of a light emitting display apparatus according to the present disclosure, FIG. 10 is a view illustrating a sampling period of a light emitting display apparatus according to the present disclosure, and FIG. 11 is a timing view illustrating a whole operation method of a light emitting display apparatus according to the present disclosure. In particular, in each of FIGS. 3 to 10, (a) represents a method in which a pixel driving circuit PDC is operated, (b) is a timing view illustrating signals used in a pixel shown in (a), and (c) is a timing view illustrating signals used in a pixel connected to a gate line of next stage, which is adjacent to a gate line shown in (a). For example, when (a) represents the operation method of the pixel driving circuit PDC provided in the pixel connected to an (m)th gate line GLm and (b) represents voltages supplied to the pixel connected with the (m)th gate line GLm or generated from the pixel connected with the (m)th gate line GLm, (c) represents the voltages supplied to the pixel connected with a (m+1)th gate line GLm+1 or generated from the pixel connected with the (m+1)th gate line GLm+1.

Hereinafter, a driving method of a light emitting display apparatus according to the present disclosure will be described with reference to a first frame period shown in FIG. 11.

First of all, a data writing period A will be described with reference to FIG. 3.

As shown in (a) and (b) of FIG. 3, an (m)th gate pulse is supplied to the (m)th gate line GLm at the data writing period A during the first frame period (m is a natural number smaller than or equal to g). The (m)th gate pulse is a signal for turning on the switching transistor Tsw1 of an (m)th gate signal GSm supplied to the (m)th gate line GLm.

At the data writing period A, an (m)th sensing pulse is supplied to an (m)th sensing control line SCLm. The (m)th sensing pulse is a signal, which turns on the sensing transistor Tsw2, of (m)th sensing control signals SSm supplied to the (m)th sensing control line SCLm.

At the data writing period A, an (m)th black-off signal is supplied to the black control line BCL. The (m)th black-off signal is a signal, which may turn off the black transistor Tsw3, of (m)th black control signals BSm supplied to the black control line BCL.

At the data writing period A, a first switching control signal SCS1 for connecting the switching unit 530 with the reference voltage generator 510 is supplied to the sensing unit 500. In this case, the first switching control signal SCS1 may have a high level. The reference voltage is supplied from the reference voltage generator 510 to the (m)th sensing line SLm through the switching unit 530 in accordance with the first switching control signal SCS1.

By the signals described as above, at the data writing period A, the sensing transistor Tsw2 and the switching transistor Tsw1 are turned on, and the black transistor Tsw3 is turned off. Therefore, a voltage Vn3 of a third node n3 between the switching transistor Tsw2 and the sensing unit 500 becomes the reference voltage, and a voltage Vn2 of a node (hereinafter, simply referred to as a second node n2) corresponding to the gate of the driving transistor Tdr becomes the data voltage Vdata supplied through the data line DL, and a voltage Vn1 of the first node n1 becomes the reference voltage.

The data voltage Vdata is charged in the storage capacitor Cst in pixels connected with the (m)th gate line GLm at the data writing period A.

In this case, a non-driving period Z proceeds in the pixels connected with the (m+1)th gate line GLm+1.

The non-driving period Z means a period immediately before the data writing period A. That is, when a data writing operation is performed for the (m)th gate line GLm, previous functions are continuously performed for the (m+1)th gate line (GLm+1).

The data writing operation described above is commonly performed in all pixels connected with the (m)th gate line GLm.

The light emitting periods B and C will be described with reference to FIGS. 4 and 5.

That is, as shown in (a) and (b) of FIGS. 4 and 5, at the light emitting period B of the first frame period, the (m)th gate-off signal is supplied to the (m)th gate line GLm. The (m)th gate-off signal is a signal, which turns off the switching transistor Tsw1, of the (m)th gate signals GSm supplied to the (m)th gate line GLm.

At the light emitting periods B and C, the (m)th sensing-off signal is supplied to the (m)th sensing control line SCLm. The (m)th sensing-off signal is a signal, which turns off the sensing transistor Tsw2, of the (m)th sensing control signals SSm supplied to the (m)th sensing control line SCLm.

At the light emitting periods B and C, the (m)th black-off signal is supplied to the black control line BCL. The (m)th black-off signal is a signal, which may turn off the black transistor Tsw3, of the (m)th black control signals BSm supplied to the black control line BCL.

At the light emitting periods B and C, the first switching control signal SCS1 for connecting the switching unit 530 with the reference voltage generator 510 is supplied to the sensing unit 500. In this case, the first switching control signal SCS1 may have a high level. The reference voltage is supplied from the reference voltage generator 510 to the (m)th sensing line SLm through the switching unit 530 in accordance with the first switching control signal SCS1.

By the signals described as above, at the light emitting periods B and C, the sensing transistor Tsw2 and the switching transistor Tsw1 are turned off, and the black transistor Tsw3 is turned off. Therefore, the voltage Vn3 of the third node n3 between the sensing transistor Tsw2 and the sensing unit 500 becomes the reference voltage. The voltage Vn2 of the second node n2 corresponding to the gate of the driving transistor Tdr is more increased than the data voltage Vdata as the driving transistor Tdr is turned on by the data voltage Vdata supplied through the data line DL, and the voltage Vn1 of the first node n1 is more increased than the reference voltage.

At the light emitting periods B and C, as the driving transistor Tdr is turned on by the data voltage Vdata charged in the storage capacitor Cst, images I are output from the pixels connected with the (m)th gate line GLm. That is, the light emitting periods B and C correspond to an image output period IDP shown in FIG. 11.

In this case, as shown in (c) of FIGS. 4 and 5, the data writing period A and the light emitting period B proceed in the pixels connected with the (m+1)th gate line GLm+1.

Therefore, there may be a period for outputting the image I from the pixels connected to the (m)th gate line GLm and the (m+1)th gate line GLm+1 at the same time.

The light emitting operation described above is commonly performed in all pixels connected with the (m)th gate line GLm.

A black output period D will be described with reference to FIG. 6.

As shown in (a) and (b) of FIG. 6, the (m)th gate-off signal is supplied to the (m)th gate line GLm at the black output period D during the first frame period. The (m)th gate-off signal is a signal, which turns off the switching transistor Tsw1, of the (m)th gate signals GSm supplied to the (m)th gate line GLm.

At the black output period D, the (m)th sensing-off signal is supplied to the (m)th sensing control line SCLm. The (m)th sensing-off signal is a signal, which turns off the sensing transistor Tsw2, of the (m)th sensing control signals SSm supplied to the (m)th sensing control line SCLm.

At the black output period D, the (m)th black pulse is supplied to the black control line BCL. The (m)th black pulse is a signal, which may turn on the black transistor Tsw3, of the (m)th black control signals BSm supplied to the black control line BCL.

At the black output period D, the first switching control signal SCS1 for connecting the switching unit 530 with the reference voltage generator 510 is supplied to the sensing unit 500. In this case, the first switching control signal SCS1 may have a high level. The reference voltage is supplied from the reference voltage generator 510 to the (m)th sensing line SLm through the switching unit 530 in accordance with the first switching control signal SCS1.

By the signals described as above, at the black output period D, the sensing transistor Tsw2 and the switching transistor Tsw1 are turned off, and the black transistor Tsw3 is turned on. Therefore, the voltage Vn3 of the third node n3 between the sensing transistor Tsw2 and the sensing unit 500 becomes the reference voltage. The voltage Vn2 of the second node n2 corresponding to the gate of the driving transistor Tdr becomes the black data voltage Vbdata by the black data voltage Vbdata supplied through the black transistor Tsw3 that is turned on, and the voltage Vn1 of the first node n1 is maintained as the voltage of the light emitting period C.

At the black output period D, as the driving transistor Tdr is turned off by the black data voltage Vbdata, black images BI are output from the pixels connected with the (m)th gate line GLm. That is, the black data voltage Vbdata supplied at the black output period D is a voltage that turns off the driving transistor Tdr, and thus no image is substantially output at the black output period D, whereby a black image BI is seen to a user's eye. The black output period D corresponds to the black image output period BIDP shown in FIG. 11.

In this case, as shown in (c) of FIG. 6, the light emitting period C proceeds in the pixels connected with the (m+1)th gate line GLm+1.

The black image output operation described above is commonly performed in all pixels connected with the (m)th gate line GLm.

Next, an initialization period E will be described with reference to FIG. 7.

As shown in (a) and (b) of FIG. 7, at the initialization period E of the first frame period, the (m)th gate-off signal is supplied to the (m)th gate line GLm.

At the initialization period E, the (m)th sensing pulse is supplied to the (m)th sensing control line SCLm. The (m)th sensing pulse is a signal, which turns on the sensing transistor Tsw2, of the (m)th sensing control signals SSm supplied to the (m)th sensing control line SCLm.

At the initialization period E, the (m)th black pulse is supplied to the black control line BCL. The (m)th black pulse is a signal, which may turn on the black transistor Tsw3, of the (m)th black control signals BSm supplied to the black control line BCL.

At the initialization period E, the first switching control signal SCS1 for connecting the switching unit 530 with the reference voltage generator 510 is supplied to the sensing unit 500. In this case, the first switching control signal SCS1 may have a high level. The reference voltage is supplied from the reference voltage generator 510 to the (m)th sensing line SLm through the switching unit 530 in accordance with the first switching control signal SCS1.

By the signals described as above, at the initialization period E, the sensing transistor Tsw2 is turned on, the switching transistor Tsw1 is turned off, and the black transistor Tsw3 is turned on. Therefore, the voltage Vn3 of the third node n3 between the sensing transistor Tsw2 and the sensing unit 500 becomes the reference voltage. The voltage Vn2 of the second node n2 corresponding to the gate of the driving transistor Tdr is initialized to the black data voltage Vbdata by the black data voltage Vbdata supplied through the black transistor Tsw3 that is turned on, and the voltage Vn1 of the first node n1 is initialized to the reference voltage Vref by the reference voltage Vref supplied through the sensing transistor Tsw2.

That is, at the initialization period E, a black data voltage (hereinafter, simply referred to as a sensing black data voltage) capable of turning on the driving transistor Tdr is supplied to a black line BL connected to a pixel (hereinafter, simply referred to as a sensing pixel), in which sensing is performed, among the pixels connected to the (m)th gate line GLm, and a black data voltage Vbdata capable of turning off the driving transistor Tdr is supplied to the black lines BL connected to the other pixels except the sensing pixel among the pixels connected to the (m)th gate line GLm in the same manner as the black output period D.

In this case, the sensing black data voltage may be set to a level in which the light emitting element is not emitted. In addition, the sensing black data voltage may be set to a level in which an image corresponding to the black image is output even when the light emitting element emits light. For example, when the light emitting display apparatus expresses 255 gray, the sensing black data voltage may be set to a level such that the light emitting element outputs an image corresponding to the black image, such as 0 gray to 3 gray. That is, even though the driving transistor Tdr of the sensing pixel is turned on by the sensing black data voltage, the sensing pixel may still output the black image BI.

That is, as shown in (a) and (b) of FIG. 7, the sensing black data voltage is supplied to the black line BL of the sensing pixel at the initialization period E, whereby the driving transistor Tdr is turned on, and the first node n1 is initialized to the reference voltage Vref.

However, at the initialization period E, the black output period D lasts in the other pixels except the sensing pixel among the pixels connected to the (m)th gate line GLm.

In addition, at the periods shown in FIGS. 3 to 6, the same operation is performed in the pixels connected to the (m)th gate line GLm. However, at the initialization period E, the initialization operation as shown in (a) and (b) of FIG. 7 is performed only in the sensing pixel where the sensing is performed, and the black image output operation described in FIG. 6 lasts in the other pixels.

Therefore, a threshold voltage sensing period TSP shown in FIG. 11 may include an initialization period E applied to the sensing pixel described with reference to (a) and (b) of FIG. 7. Also, at the threshold voltage sensing period TSP shown in FIG. 11, the black output period D, that is, the black image output period BIDP, may last in the other pixels except the sensing pixel.

In addition, in the present disclosure, a threshold voltage is sensed only for one pixel among pixels connected to one gate line, that is, a sensing pixel.

In this case, as shown in (c) of FIG. 7, the black output period D proceeds in the pixels connected to the (m+1)th gate line GLm+1.

Hereinafter, the operations described with reference to FIGS. 8 to 10 are also performed only in the sensing pixel. That is, the operations described with reference to FIGS. 3 to 6 are applied to all pixels connected to the (m)th gate line GLm, and the operations described with reference to FIGS. 7 to 10 are applied only to the sensing pixel of the pixels connected to the (m)th gate line GLm. In this case, the black image BI may continuously be output in the other pixels except the sensing pixel. Therefore, the output period D, that is, the black image output period BIDP shown in FIG. 11 is applied to the other pixels except the sensing pixel.

Sensing periods F and G will be described with reference to FIGS. 8 and 9.

As shown in (a) and (b) of FIGS. 8 and 9, the (m)th gate-off signal is supplied to the (m)th gate line GLm at the sensing period F and G of the first frame period.

The (m)th sensing pulse is supplied to the (m)th sensing control line SCLm at the sensing periods F and G. The (m)th sensing pulse is a signal, which turns on the sensing transistor Tsw2, of the (m)th sensing control signals SSm supplied to the (m)th sensing control line SCLm.

At the sensing periods F and G, the (m)th black pulse is supplied to the black control line BCL. The (m)th black pulse is a signal, which may turn on the black transistor Tsw3, of the (m)th black control signals BSm supplied to the black control line BCL.

A first switching control signal SCS1 for connecting the switching unit 530 with the conversion unit 520 is supplied to the sensing unit 500 at the sensing periods F and G. In this case, the first switching control signal SCS1 may have a low level. However, even though the sensing line SL is connected with the conversion unit 520 by the first switching control signal SCS1, since the switch 522 provided in the conversion unit 520 is not connected to the converter 521, the sensing signal corresponding to the threshold voltage of the driving transistor Tdr is not supplied to the converter 521. Therefore, the third node n3 is floated.

By the signals described as above, at the sensing periods F and G, the sensing transistor Tsw2 is turned on, the switching transistor Tsw1 is turned off, and the black transistor Tsw3 is turned on. In this case, the voltage Vn3 of the floated third node n3 is more increased than the reference voltage. The voltage Vn2 of the second node n2 corresponding to the gate of the driving transistor Tdr is maintained as the sensing black data voltage Vbdata by the sensing black data voltage supplied through the black transistor Tsw3 that is turned on, and the voltage Vn1 of the first node n1 is more increased than the reference voltage Vref supplied through the sensing transistor Tsw2.

By the operations described as above, the threshold voltage of the driving transistor Tdr provided in the sensing pixel may be sensed.

That is, since the third node n3 is floated and the sensing transistor Tsw2 is turned on, the first node n1, which is the source of the driving transistor Tdr, is floated, whereby the first node n1 and the third node n3 are equipotential with the sensing line SL. Therefore, the voltage corresponding to the threshold voltage of the driving transistor Tdr may be sensed at the first node n1 and the third node n3.

In this case, as shown in (c) of FIGS. 8 and 9, the initialization period E and the sensing period F proceed in the pixels connected to the (m+1)th gate line GLm+1.

That is, according to the present disclosure, the sensing lines SL are provided along the gate lines GL, and the sensing lines SL may be driven independently. Therefore, when the initialization operation and the threshold voltage sensing operation are performed, as described with reference to (a) and (b) of FIGS. 7 to 9, in the sensing pixel connected to the (m)th gate line GLm, an image or a black image may be output from pixels connected to another gate line, for example, the (m+1)th gate line GLm+1, or the initialization operation or the sensing operation may be performed.

This operation cannot be performed in the light emitting display apparatus of the related art, in which sensing lines are disposed in parallel with the data lines. That is, in accordance with the sensing control signal SS supplied through the sensing control line and the timing at which the gate pulse is supplied to the gate line, the initialization operation and the threshold voltage sensing operation may be performed independently. However, in the light emitting display apparatus of the related art, one sensing line is disposed in parallel with the data lines and thus one sensing line is commonly connected to the pixels connected with the plurality of gate lines. In this case, only one operation, for example, the initialization operation or the threshold voltage sensing operation, may be performed in the pixels connected to one sensing line. Therefore, an individual operation cannot be performed for each gate line in the light emitting display apparatus of the related art.

In addition, when the threshold voltage sensing operation is performed for pixels connected to one gate line, a light emitting operation or an initialization operation should be performed in the other gate lines. When the threshold voltage sensing operation is performed, the source node and the sensing line of the driving transistor should be equipotential, and when another operation is performed, different voltages should be applied to each node and sensing line for each operation. However, like the light emitting display apparatus of the related art, when the sensing line is provided in a vertical direction parallel with the data line, voltages are shared because the sensing line is connected to all gate lines, whereby each operation cannot be performed normally.

Finally, the sampling period H will be described with reference to FIG. 10.

That is, as shown in (a) and (b) of FIG. 10, at the sampling period H of the first frame period, the (m)th gate-off signal is supplied to the (m)th gate line GLm.

At the sampling period H, the (m)th sensing-off signal is supplied to the (m)th sensing control line SCLm.

The (m)th black off signal is supplied to the black control line BCL at the sampling period H.

At the sampling period H, the first switching control signal SCS1 for connecting the switching unit 530 with the conversion unit 520 is supplied to the sensing unit 500. In this case, the first switching control signal SCS1 may have a low level. Also, a second switching control signal SCS2 is supplied to the switch 522 included in the conversion unit 520. The switching unit 530 is connected to the converter 521 by the second switching control signal SCS2. Therefore, the sensing line SL is connected to the converter 521 through the switching unit 530 and the switch 522.

By the signals described as above, at the sampling period H, the sensing transistor Tsw2 is turned off, the switching transistor Tsw1 is turned off, and the black transistor Tsw3 is turned off. In this case, the voltage Vn3 of the third node n3 becomes a voltage corresponding to the threshold voltage.

Since the third node n3 is connected with the sensing line SL and the sensing line SL is connected to the converter 521 through the switching unit 530 and the switch 522, the voltage Vn3 of the third node is supplied to the converter 521.

The converter 521 converts the sensed voltage Vn3 of the third node into sensing data, and transmits the sensing data to the controller 400.

The controller 400 may calculate a change amount of the threshold voltage of the driving transistor of the sensing pixel by using the sensing data. As described above, the controller 400 may convert input image data corresponding to the sensing pixel into image data by using the calculated change amount. Therefore, a data voltage capable of compensating for the change amount of the threshold voltage is supplied to the data line of the sensing pixel. Therefore, even though the threshold voltage of the sensing pixel is changed, a normal image may be output from the sensing pixel.

That is, the voltage corresponding to the threshold voltage of the driving transistor Tdr is applied to the first node n1 and the third node n3, which are floated at the sensing periods F and G. At the sampling period H, the voltage applied to the third node n3 is supplied to the converter 521, and the converter 521 converts the voltage applied to the converter 521, that is, the voltage corresponding to the threshold voltage, into the sensing data and then transmits the sensing data to the controller 400. Therefore, sensing data corresponding to the threshold voltage of the driving transistor Tdr may be generated at the sampling period H.

In addition, the threshold voltage of the driving transistor Tdr may be sensed by inputting a predetermined voltage, for example, the sensing black data voltage Vbdata to the gate of the driving transistor Tdr, that is, the second node n2 and floating the source of the driving transistor Tdr, that is, the first node n1. That is, the threshold voltage of the driving transistor Tdr may be sensed by a source follower operation. In this case, a current flowing to the source, e.g., the first node n1, is close to zero(0), and thus the voltage of the first node n1 may be sensed as the threshold voltage of the driving transistor Tdr. In particular, since the voltage of the first node n1 and the voltage of the third node n3 at the sensing periods G and F are the same as each other, the voltage of the third node n3, which is measured at the sampling period H, may be a voltage corresponding to the threshold voltage.

In this case, as shown in (c) of FIG. 10, the sensing period G may proceed in the pixels connected to the (m+1)th gate line GLm+1.

The initialization period E, the sensing periods F and G and the sampling period H, which are described with reference to FIGS. 7 to 10, are included in the threshold voltage sensing period TSP shown in FIG. 11.

That is, according to the present disclosure described as above, images and black images may be output to all gate lines at the first frame period, and thus a black image mode may be applied.

Also, at the first frame period, threshold voltage sensing may be performed for all gate lines, and in this case, a threshold voltage is sensed only for one of the pixels connected to one gate line, that is, a sensing pixel.

Therefore, when the number of data lines DL provided in the light emitting display panel is 'd,' the threshold voltage sensing may be performed for all pixels provided in the light emitting display panel.

Also, threshold voltages do not need to be continuously sensed for all pixels provided in the light emitting display panel.

For example, even though the light emitting display apparatus used for outputting an advertisement is driven for a long time, such as a few hours or several tens of hours, the threshold voltage of the driving transistors is not changed rapidly.

Therefore, the threshold voltage sensing operation described with reference to FIGS. 7 to 10 may occur once every several hours or several tens of hours. In this case, when the threshold voltage sensing operation starts, since the threshold voltages for all pixels should be sensed as described above, the threshold voltage sensing operation described with reference to FIGS. 7 to 10 may be performed during the first to (d)th frame periods.

Therefore, the controller may calculate change amounts of the threshold voltages of all pixels provided in the light emitting display panel 100 by performing the operations as shown in FIGS. 7 to 10 for a period of time preset by a user, for example, 10 hours or 5 hours, and may correct the input image data by using the calculated change amounts of the threshold voltages.

Accordingly, in some embodiments, the controller may generate the signals used for the description of FIGS. 7 to 10 every preset period of time and transmit the generated signals to the sensing unit 500, the data driver 300 and the gate driver 200.

Hereinafter, the present disclosure described as above will briefly be summarized.

That is, the light emitting display apparatus according to the present disclosure includes a light emitting display panel 100 provided with light emitting elements ED, a data driver 300 for supplying a data voltage to a data line provided along a first direction of the light emitting display panel, a gate driver 200 for supplying a gate signal to a gate line provided in the light emitting display panel along a second direction different from the first direction, a sensing unit 500 for supplying a reference voltage to a sensing line provided in the light emitting display panel along the second direction, and a controller 400 for controlling the data driver, the gate driver and the sensing unit.

In particular, the light emitting display panel 100 includes a data line DL provided along the first direction, a black line BL provided along the first direction, a first voltage supply line PLA provided along the first direction, a gate line GL provided along the second direction, a sensing line SL provided along the second direction, a sensing control line SCL provided along the second direction, a black control line BCL provided along the second direction, a pixel driving circuit PDC connected with the data line, the black line, the first voltage supply line, the gate line, the sensing line, the sensing control line and the black control line, and a light emitting element ED connected to the pixel driving circuit.

The pixel driving circuit PDC includes a driving transistor Tdr connected between the first voltage supply line PLA and the light emitting element, a switching transistor Tsw1 connected between a gate of the driving transistor and the data line, a black transistor Tsw3 connected between the gate of the driving transistor and the black line, a sensing transistor Tsw2 connected between a first node n1 between the driving transistor and the light emitting element and the sensing line, and a storage capacitor Cst provided between the gate of the driving transistor and the first node n1.

The sensing unit 500 may convert the (m)th sensing signal transmitted from one of the pixels provided along the (m)th gate line, that is, the (m)th sensing signal transmitted from the sensing pixel, into the (m)th sensing data when the black image is output from the pixels provided along the (m)th gate line GLm among the gate lines provided in the light emitting display panel. In this case, the black image is continuously output even from the sensing pixel. Therefore, as shown in FIG. 11, the threshold voltage sensing period TSP may be included in the black image output period BIDP.

The sensing unit 500 converts sensing signals sequentially transmitted from all sensing lines provided in the light emitting display panel into sensing data during one frame period. That is, in the present disclosure, sensing signals are sequentially generated from all sensing lines and transmitted to the sensing unit 500. In this case, only one sensing signal is transmitted to the sensing unit 500 through one sensing line.

When the number of data lines provided in the light emitting display panel is 'd,' sensing data for all pixels provided in the light emitting display panel may be generated after the first to (d)th frame periods. That is, since the threshold voltage is sensed only for one pixel among the pixels connected to one gate line at one frame period, the first to (d)th frame periods should pass in order to sense the threshold voltages for all pixels connected to one gate line.

The gate driver 200 outputs a gate pulse to the (m)th gate line GLm of the gate lines provided in the light emitting display panel and outputs a black pulse to the (m)th black control line among the black control lines BCL provided in the light emitting display panel at the black output period D, wherein 'm' is a natural number smaller than or equal to the number 'g' of gate lines.

The data driver 300 supplies the black data voltage Vbdata, which may turn off the driving transistor, to all black lines BL provided in the light emitting display panel at the black output period D.

The data driver 300 supplies a (k)th black data voltage, which turns on a (k)th driving transistor, to a (k)th black line connected to a pixel (sensing pixel), in which sensing is performed, among pixels connected to the (m)th black control line, at an initialization period E generated after the black output period D, wherein the (k)th driving transistor is connected to the (k)th black line, and 'k' is a natural number smaller than or equal to 'd,' which is the number of data lines. The (k)th black data voltage means the sensing black data voltage described above.

At the initialization period E, the gate driver 200 supplies a sensing pulse, which may turn on the sensing transistors Tsw2, to the (m)th sensing control line among the sensing control lines SCL provided in the light emitting display panel, and the sensing unit 500 supplies a reference voltage Vref to an (m)th sensing line SLm among the sensing lines provided in the light emitting display panel.

At the sensing periods F and G generated after the initialization period E, the sensing unit 500 floats the (m)th sensing line SLm.

The sensing unit 500 includes a converter 521, and at the sampling period H generated after the sensing periods F and G, the gate driver 200 supplies a sensing-off signal, which may turn off the sensing transistors Tsw2, to the (m)th sensing control line SCLm, and the sensing unit connects an (m)th converter corresponding to the (m)th sensing line SLm with the (m)th sensing line SLm. The (m)th converter converts the (m)th sensing signal supplied through the (m)th sensing line SLm into (m)th sensing data, which is a digital value, and transmits the (m)th sensing data to the controller 400.

In order to perform the functions described as above, the sensing unit 500 includes a reference voltage generator 510 for generating the reference voltage Vref, a conversion unit 520 for converting the sensing signal received through the sensing line SL into digital sensing data and transmitting the sensing data to the controller 400, and a switching unit 530 for connecting the sensing line SL to the reference voltage generator 510 or the conversion unit 520.

The conversion unit 520 includes a converter 521 for converting the sensing signal into digital sensing data and transmitting the sensing data to the controller 400, and a switch 522 for connecting the converter 521 to the switching unit 530 or not connecting the converter 521 to the switching unit 530.

According to the present disclosure, the following advantageous effects may be obtained.

According to the present disclosure, the threshold voltage of the driving transistor may be sensed at one frame period even in the light emitting display apparatus based on a black image mode in which a black image is output after an image is output.

Therefore, according to the present disclosure, the change amount of the threshold voltage of the driving transistor may be sensed in real time even in the light emitting display apparatus based on a black image mode, which is used for output of an advertisement, or the light emitting display apparatus based on a black image mode and used for a long time after being turned on once, whereby quality of the light emitting display apparatus may be prevented from being deteriorated.

It will be apparent to those skilled in the art that the present disclosure described above is not limited by the above-described embodiments and the accompanying drawings and that various substitutions, modifications and variations can be made in the present disclosure without departing from the spirit or scope of the disclosures. Consequently, the scope of the present disclosure is intended to cover all variations or modifications derived from the meaning, scope and equivalent concept of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light emitting display panel comprising:

a data line provided along a first direction;

a black line provided along the first direction;

a first voltage supply line provided along the first direction;

a gate line provided along a second direction different from the first direction;

a sensing line provided along the second direction;

a sensing control line provided along the second direction;

a black control line provided along the second direction;

a pixel driving circuit coupled with the data line, the black line, the first voltage supply line, the gate line, the sensing line, the sensing control line and the black control line;

a light emitting element coupled to the pixel driving circuit, wherein a reference voltage or a sensing signal is transmitted through the sensing line, wherein the sensing line is electrically connected to pixel driving circuits, wherein the sensing line is parallel to the gate line, wherein adjacent sensing lines are not connected to each other in a display area, and wherein the sensing line and the gate line cross the data line, wherein sensing data for all pixels provided in the light emitting display panel are generated after first to (d)th frame periods when the number of data lines provided in the light emitting display panel is 'd', and the sensing data are generated by using sensing signals transmitted through sensing lines.

2. The light emitting display panel of claim 1, wherein the pixel driving circuit includes:

a driving transistor coupled between the first voltage supply line and the light emitting element;

a switching transistor coupled between a gate of the driving transistor and the data line;

a black transistor coupled between the gate of the driving transistor and the black line;

a sensing transistor coupled between a first node between the driving transistor and the light emitting element and the sensing line; and a storage capacitor provided between the gate of the driving transistor and the first node.

3. A light emitting display apparatus comprising:

a light emitting display panel provided with light emitting elements;

a data driver supplying a data voltage to a data line provided along a first direction of the light emitting display panel;

a gate driver supplying a gate signal to a gate line provided in the light emitting display panel along a second direction different from the first direction;

a sensing circuit supplying a reference voltage to a sensing line provided in the light emitting display panel along the second direction or converting a sensing signal transmitted through the sensing line into sensing data; and a controller controlling the data driver, the gate driver and the sensing circuit wherein the reference voltage or the sensing signal is transmitted through the sensing line, wherein the sensing line is electrically connected to pixels parallel to the gate line, wherein adjacent sensing lines are not connected to each other, wherein the sensing line and the gate line cross the data line, and wherein sensing data for all pixels provided in the light emitting display panel are generated after first to (d)th frame periods when the number of data lines provided in the light emitting display panel is 'd'.

4. The light emitting display apparatus of claim 3, wherein the light emitting display panel includes:

the data line provided along the first direction;

a black line provided along the first direction;

a first voltage supply line provided along the first direction;

the gate line provided along the second direction;

the sensing line provided along the second direction;

a sensing control line provided along the second direction;

a black control line provided along the second direction;

a pixel driving circuit coupled with the data line, the black line, the first voltage supply line, the gate line, the sensing line, the sensing control line and the black control line; and a light emitting element coupled to the pixel driving circuit.

5. The light emitting display apparatus of claim 4, wherein the pixel driving circuit includes:

a driving transistor coupled between the first voltage supply line and the light emitting element;

a switching transistor coupled between a gate of the driving transistor and the data line;

a black transistor coupled between the gate of the driving transistor and the black line;

a sensing transistor coupled between a first node between the driving transistor and the light emitting element and the sensing line; and a storage capacitor provided between the gate of the driving transistor and the first node.

6. The light emitting display apparatus of claim 4, wherein the gate driver outputs a gate pulse to an (m)th gate line among gate lines provided in the light emitting display panel and outputs a black pulse to an (m)th black control line among black control lines provided in the light emitting display panel during a black output period, the data driver supplies a black data voltage capable of turning off the driving transistor to all black lines provided in the light emitting display panel during the black output period, and the data driver supplies a (k)th black data voltage, which turns on a (k)th driving transistor, to the (k)th black line coupled to a pixel, in which sensing is performed, among pixels coupled to the (m)th black control line, at an initialization period generated after the black output period, the (k)th driving transistor being coupled to the (k)th black line.

7. The light emitting display apparatus of claim 6, wherein, at the initialization period, the gate driver supplies a sensing pulse capable of turning on the sensing transistors to an (m)th sensing control line among sensing control lines provided in the light emitting display panel, and the sensing circuit supplies a reference voltage to an (m)th sensing line among sensing lines provided in the light emitting display panel.

8. The light emitting display apparatus of claim 6, wherein the sensing circuit floats the (m)th sensing line at a sensing period generated after the initialization period.

9. The light emitting display apparatus of claim 8, wherein the sensing circuit includes converters, at a sampling period generated after the sensing period, the gate driver supplies a sensing-off signal capable of turning off the sensing transistors to the (m)th sensing control line, the sensing circuit couples an (m)th converter corresponding to the (m)th sensing line with the (m)th sensing line, and the (m)th converter converts an (m)th sensing signal supplied through the (m)th sensing line into (m)th sensing data, which is a digital value, and transmits the (m)th sensing data to the controller.

10. The light emitting display apparatus of claim 3, wherein the sensing circuit converts an (m)th sensing signal transmitted from one of pixels provided along an (m)th gate line into (m)th sensing data when a black image is output from the pixels provided along the (m)th gate line among gate lines provided in the light emitting display panel.

11. The light emitting display apparatus of claim 3, wherein the sensing circuit converts sensing signals sequentially transmitted from all sensing lines provided in the light emitting display panel into sensing data during one frame period.

12. The light emitting display apparatus of claim 3, wherein the sensing circuit includes:

a reference voltage generator generating the reference voltage;

a conversion circuit converting the sensing signal received through the sensing line into digital sensing data and transmitting the digital sensing data to a controller; and a switching circuit coupling the sensing line to the reference voltage generator or the conversion circuit.

13. The light emitting display apparatus of claim 12, wherein the conversion circuit includes:

a converter converting the sensing signal into digital sensing data and transmitting the digital sensing data to the controller; and a switch coupling the converter to the switching circuit or not.

14. The light emitting display apparatus of claim 13, wherein the controller generates a sensing control signal for controlling the sensing unit, the sensing control signal including a first switching control signal for controlling the switching unit and a second switching control signal for controlling the switch.

15. A light emitting display apparatus comprising:

a light emitting display panel provided with light emitting elements;

a data driver supplying a data voltage to a data line provided along a first direction of the light emitting display panel;

a gate driver supplying a gate signal to a gate line provided in the light emitting display panel along a second direction different from the first direction;

a sensing circuit supplying a reference voltage to a sensing line provided in the light emitting display panel along the second direction or converting a sensing signal transmitted through the sensing line into sensing data; and a controller controlling the data driver, the gate driver and the sensing circuit, wherein the reference voltage or the sensing signal is transmitted through the sensing line, wherein the sensing line and the gate line cross the data line, and wherein sensing data for all pixels provided in the light emitting display panel are generated after first to (d)th frame periods when the number of data lines provided in the light emitting display panel is 'd'.

16. A light emitting display apparatus comprising:

a light emitting display panel provided with light emitting elements;

a data driver supplying a data voltage to a data line provided along a first direction of the light emitting display panel;

a gate driver supplying a gate signal to a gate line provided in the light emitting display panel along a second direction different from the first direction;

a sensing unit supplying a reference voltage to a sensing line provided in the light emitting display panel along the second direction or converting a sensing signal transmitted through the sensing line into sensing data; and a controller controlling the data driver, the gate driver and the sensing unit, the controller including:

a data aligner realigning input image data transmitted from an external system using a timing synchronization signal transmitted from the external system, a control signal generator generating a gate control signal and a data control signal by using the timing synchronization signal, an input unit receiving the timing synchronization signal and the input image data and transmitting them to the data aligner and the control signal generator respectively, and an output unit outputting the realigned image data generated by the data aligner and the data control signal generated by the control signal generator to the data driver, and outputting the gate control signal generated by the control signal generator to the gate driver wherein the reference voltage or the sensing signal is transmitted through the sensing line, wherein the sensing line is electrically connected to pixels parallel to the gate line, wherein adjacent sensing lines are not connected to each other, and wherein the sensing line and the gate line cross the data line-, and wherein sensing data for all pixels provided in the light emitting display panel are generated after first to (d)th frame periods when the number of data lines provided in the light emitting display panel is 'd'.

17. The light emitting display apparatus of claim 16, wherein the input unit determines a change amount of a threshold voltage of a driving transistor provided in a pixel, by using the sensing data received from the sensing unit, and calculates a correction value by using the change amount of the threshold voltage.

18. The light emitting display apparatus of claim 17, wherein the data aligner generates the realigned image data by using the input image data and the correction value.

19. The light emitting display apparatus of claim 18, wherein the data driver converts the realigned image data into a data voltage and transmits the data voltage to the pixel through the data line, such that the pixel outputs an image based on the data voltage in which the correction value is reflected.

20. The light emitting display apparatus of claim 16, wherein the data aligner further generates black image data, and wherein the data driver converts the black image data received from the output unit into a black data voltage and transmits the black data voltage to a pixel through the data line, such that the pixel outputs a black image.

* * * * *